United States Patent [19]

Dreyer

[11] 4,333,697

[45] Jun. 8, 1982

[54] ADAPTER FOR A COAXIAL CONNECTOR

[75] Inventor: Charles W. Dreyer, Fairfield, Conn.

[73] Assignee: Sealectro Corporation, Mamaroneck, N.Y.

[21] Appl. No.: 168,623

[22] Filed: Jul. 14, 1980

[51] Int. Cl.[3] ..... H01R 13/00

[52] U.S. Cl. ..... 339/31 R; 339/154 A; 339/177 R

[58] Field of Search ..... 339/31 R, 31 M, 154 R, 339/154 A, 177

[56] References Cited

U.S. PATENT DOCUMENTS 3,058,089 10/1962 Leido ..... 339/31 R 4,206,963 6/1980 English et al. ..... 339/154 A

*Primary Examiner*—Joseph H. McGlynn

*Attorney, Agent, or Firm*—Anthony J. Casella

[57] ABSTRACT

An adapter is disclosed for mounting on the mating end of a female slide on type coaxial connector to enable the direct mating between the latter and a male coupling type coaxial connector. More particularly, an adapter is disclosed which when mounted on a female slide on coaxial connector, results in a connector combination having a mating end with a configuration substantially similar to the configuration of a female, coupling type coaxial connector. The subject adapter is of generally elongated, cylindrical configuration having a mating end. The outer surface of the adapter is threaded, with the inner surface thereof including major and minor diameter portions separated by circumferential step. The minor diameter portion, which is disposed adjacent the mating end of the adapter, is configured to receive the mating end of the female, slide on coaxial connector. The major diameter portion of the adapter is threaded and is connectable to a threaded portion on the female slide on coaxial connector. In use, a direct interface is achieved between a female slide on coaxial connector and a male coupling type connector such that the high frequency characteristics of the connection are substantially maintained.

6 Claims, 5 Drawing Figures

ADAPTER FOR A COAXIAL CONNECTOR

BACKGROUND OF THE INVENTION

This invention relates to an adapter for use with a female slide on coaxial connector member. More specifically, an adapter is disclosed which is connectable to a female slide on type coaxial connector member for altering the configuration of the mating end thereof to approximate the configuration of the mating end of a prior art coupling type connector member. By this arrangement, a slide on type connector member can be readily mated with a coupling type connector member without the addition of an extra interface therebetween which would degrade the characteristics of the electrical connection.

In recent years, there has been developed a group of industry standard, high frequency coaxial connectors. The specific configuration of these coupling type coaxial connectors has been embodied in Military Specifications 39012/80A and 83A. The latter specifications included designs for both a male jack connector member and a female plug connector member, respectively. These coaxial connectors have gained wide acceptance in the industry since they provided excellent high frequency characteristics, and can be utilized to carry frequencies in the range of up to 18 GHZ. One shortcoming of these prior art electrical connectors is that in order to produce a high frequency connection, it is necessary to use a coupling nut to draw the opposed mating connector members together to achieve a secure interengagement therebetween. Thus, in applications where limited space would preclude access to the coupling nuts, these coupling type connector members could not be effectively utilized.

In order to overcome this shortcoming, a new and improved coaxial connector was developed which was capable of achieving a high frequency interengagement without the need of a coupling nut. More particularly, a new slide on type electrical connector was developed, which is disclosed in copending U.S. Patent Application No. 135,004, assigned to the same assignee as the subject invention (the disclosure of which is incorporated herein by reference), and is operative to achieve a redundant or dual electrical connection between the opposed connector members thereby providing the characteristics necessary for high frequency applications. While the unique slide on type coaxial connector overcomes many of the shortcomings of the coupling type coaxial connector, the two types of connectors are incompatable. More specifically, a slide on connector member cannot be directly mated to a coupling connector member and thus, it is necessary to provide some type of intermediary interface therebetween. For example, a cable may be provided having at one end thereof the mating configuration of a coupling connector member, while the opposed end of the cable is provided with the configuration of a slide on connector member.

While new equipment is manufactured which exclusively utilizes the improved slide on connectors, mismatches between connectors will frequently occur when new equipment needs to be hooked up to earlier manufactured devices. For example, new test equipment must be mated in the field with devices having coupling connectors. Also improved black-box type devices are often installed to update existing equipment. In practice, test equipment and so called black box devices, which are movable, are provided with female or jack type connector members. Conversely, fixed immovable equipment are generally provided with male or plug type connector members. This arrangement is common since the protruding plug of a male connector member is easily damaged and therefore it is preferable to mount the male connector member on immovable equipment, rather than test equipment, which is frequently transported, such that the risk of damage to the plug is minimized. Thus, the most frequent situations where mismatches occur is where a female slide on type connector member, mounted on new test equipment, must be mated with a male coupling type connector member found on devices in the field.

One solution to this mismatch problem is to provide a flexible cable having at one end thereof the mating configuration of a female coupling connector member, and at the other end the configuration of a male slide on connector member. This type of interface will bridge the gap between a male coupling connector member and a female slide on connector member. One of the shortcomings of using the above described connector cables, is that the additional length of wire between the connector members tends to degrade the performance of the connection. Even more importantly, this type of connector cable introduces two interfaces where before there was only one. More specifically, a coupling interface is introduced at both of the connector members. Since the electrical characteristics of a connector, especially in high frequency application ranges, is severely effected by each additional interface, the use of a connector cable which effectively doubles the number of interfaces per electrical connection, results in a substantial and undesirable degradation of electrical performance. Accordingly, it would be desirable to provide a means for connecting a female slide on connector member directly to a male coupling connector member wherein only a single interface between the members is necessary thereby maintaining the performance characteristics of the connection.

Therefore, it is an object of the subject invention to provide a new and improved adapter for use in conjunction with high frequency coaxial connectors which permits the direct connection between a female slide on connector member and a male coupling connector member.

It is another object of the subject invention to provide an adapter that is mounted on a female slide on connector member which alters the configuration of the mating end of the latter to approximate the configuration of a female coupling connector member.

It is a further object of the subject invention to provide an adapter which is relatively inexpensive to manufacture and may be removably mounted on a female slide on connector member to facilitate a direct, single interface connection with a male coupling connector member.

In accordance with these and many other objects, the subject invention provides for an adapter which is connectable to the mating end of a female slide on coaxial connector member. The female slide on connector member includes a central conductor surrounded by a tubular insulator and has a generally cylindrical outer conductor. The mating end of the outer conductor is provided with a plurality of longitudinally extending slits which define a plurality of cantilevered spring fingers that flare radially outwardly towards the mating end thereof. The outer conductor further includes a threaded portion which is spaced from the mating end of the conductor and has a diameter greater than the diameter of the outer conductor adjacent the mating end.

The new and improved adapter of the subject invention has a generally elongated cylindrical configuration, with the outer surface thereof being threaded and having a diameter corresponding to the diameter of a female coupling type coaxial connector member. The inner surface of the adapter is provided with major and minor diameter portions separated by a circumferential step. The minor diameter portion, which is disposed adjacent the mating end of the adapter, has a diameter substantially corresponding to the diameter of the mating end of the female slide on connector member. The major diameter portion, which is disposed adjacent the opposed end of the adapter, is provided with a plurality of threads which are adapted to engage the threaded portion of the outer conductor of the female slide on connector member. Preferably, the opposed end of the adapter is additionally provided with a hexagonal outer configuration to facilitate the tightening of the adapter onto the female connector.

In use, the mating end of the female slide on connector member is received within the end of the adapter. More particularly, the cantilevered spring fingers are compressed and received in the minor diameter portion of the adapter. The threaded portion of the female connector is engaged with the threaded portion of the major diameter portion of the adapter. When the adapter is fully tightened onto the slide on connector member, the distal end of the threaded portion of the latter is in abutting relationship with the circumferential step of the adapter. The dimensions of the adapter are so arranged that the mating end of the combined connector member and adapter substantially corresponds to the configuration of a female coupling type connector member. The combined adapter-connector member can then be directly mated with a male coupling connector member, and a coupling nut may be used to insure that a high frequency electrical contact is achieved therebetween.

Other objects and advantages of the subject invention will become apparent from the following detailed description when taken in conjunction with the drawings in which:

DESCRIPTION OF THE PREFERRED EMBODIMENT

Figure 1:
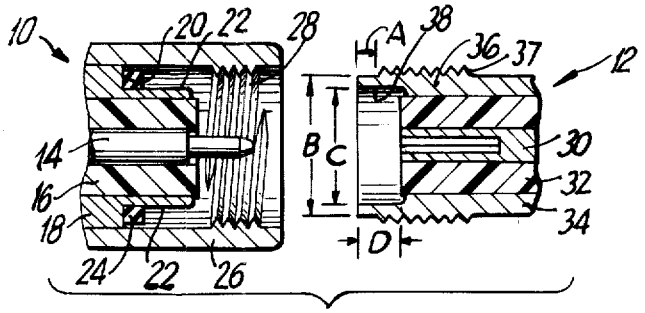
FIG. 1 (PRIOR ART)
FIG. 1 is a cross sectional view of the prior art coaxial coupling type coaxial connector members with the male plug member shown on the left and the female jack member shown on the right.

Referring to FIG. 1, there is illustrated in cross section, the mating ends of a pair of coaxial coupling-type connector members. More specifically, a male connector member 10 is illustrated on the left hand side of FIG. 1, while a female connector member 12 is illustrated on the right. The male connector member 10 includes a central metallic conductor terminal 14 which is surrounded by a tubular insulator 16. A generally cylindrical outer conductor 18 surrounds the insulator 16, and includes an L-shaped undercut area 20 which defines an electrical contact area 22 of reduced diameter. A rubber O-ring 24 may be placed around the reduced diameter area 22 to act as a moisture sealing barrier. A coupling nut 26 having internal threads 28, surrounds the outer conductor 18 and is freely rotatable therearound. The coupling nut is utilized to draw connector members 10 and 12 into a tight, abutting relationship as more fully described hereinafter.

The female connector member 12 includes a central conductor 30 which is hollow and adapted to receive the central conductor 14 of the male connector member 10. Central conductor 30 is surrounded by a tubular insulator 32, which is in turn, surrounded by a generally cylindrical outer conductor 34. In accordance with Military Specification 39012/83A, the outer conductor 36 is provided with a plurality of threads 37 which are spaced from the mating end thereof. More specifically, the threads 37 are spaced from the mating end a distance A which is required to be in the range between 0.015 to 0.045 inches. The diameter of the outer conductor 36 in the area of the threads 37 is 0.250 inches, whereas the outer diameter B of the mating end is intended to fall within the range of 0.208 to 0.216 inches. The inner diameter C of the mating end of the outer conductor 34 has a minimum diameter of 0.181 inches. The amount the insulator 32 is recessed from the mating end of the outer conductor 36, represented as distance D, falls within the range of 0.074 to 0.078 inches. When the connector members 10 and 12 are mated, the central conductor 14 of the connector member 10 is received within the hollow central conductor 30 of the connector member 12, and the inner surface 38 of outer conductor 34 abuts contact area 22 of outer conductor 18. In order to insure the passage of the high frequency signals, coupling nut 26 is tightened around the female connector member 12. More specifically, the threads 28 of the coupling nut 26 are engaged with the threads 37 of the outer conductor 36 and the nut is rotated thereby drawing the members into a tight abutting relationship. By this arrangement, the coupling connector members are capable of carrying signals up to 18 Ghz.

Figure 2:
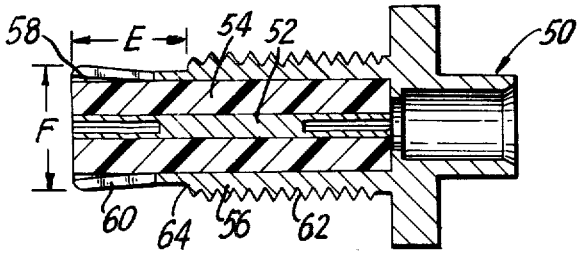
FIG. 2 (PRIOR ART)
FIG. 2 is a cross sectional view of a female slide on type coaxial connector.

Turning to FIG. 2, there is illustrated an improved female slide on connector member 50 of the type which is disclosed in copending U.S. patent application No. 135,004, assigned to the same assignee as the subject invention. The slide on coaxial connector member 50 includes a central conductor 52 surrounded by a tubular insulator 54. The configuration and dimensions of the central conductor and tubular insulator of a coaxial connector are dependent upon the type of high frequency signals which are to be transmitted and hence, the configurations of the central conductor and tubular insulator of the slide on connector member 50 and the coupling connector member 12 are substantially the same. Tubular insulator 54 is surrounded by a generally cylindrical outer conductor 56. The mating end of the outer conductor 56 includes a plurality of longitudinally extending slits 58 which define cantilevered spring fingers 60 that flare radially outwardly towards the mating end of the conductor. As disclosed in the earlier filed copending application, the cantilevered spring fingers cooperate with an improved slide on male jack connector member to produce a high frequency coaxial connection. Preferably, outer conductor 56 further includes a threaded portion 62 to facilitate the mounting of the connector member in a threaded aperture of a mounting plate. The distal end 64 of the threads are spaced a distance E, equaling 0.164, inches from the mating end of the outer conductor. The diameter F of the mating end of the outer conductor 56 is 0.184 inches when the spring fingers 60 are fully flared and 0.180 inches when the fingers are compressed.

Figure 3:
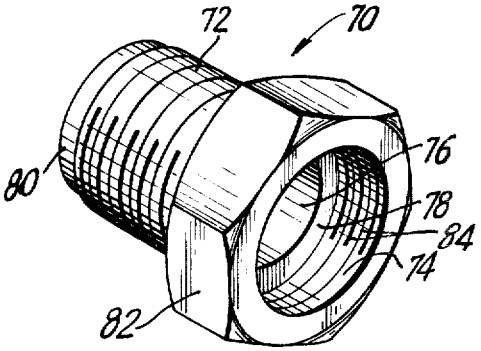
FIG. 3 is a perspective view of the new and improved adapter of the subject invention.

It is apparent from the illustrations in FIGS. 1 and 2 that a mating between the female slide on connector member 50 and the male coupling connector member 10 would be difficult, if not impossible, without a proper interface. Accordingly, and as illustrated in FIG. 3, the subject invention provides for a unique adapter 70 which when mounted on a female slide on connector member 50 alters the configuration of its mating end such that it substantially conforms to the configuration of a female coupling type connector member 12. The subject adapter 70 is of generally cylindrical configuration having an outer threaded surface 72 and an inner surface consisting of major and minor diameter portions 74 and 76 respectively, which are separated by circumferential step 78. Circumferential step 78 is disposed perpendicular to the longitudinal axis of the adapter. Preferably, the end of adapter 70, opposed to the mating end 80, is provided with a hexagonal configuration 82 to facilitate the mounting of the adapter onto slide on connector member 50.

Figure 4:
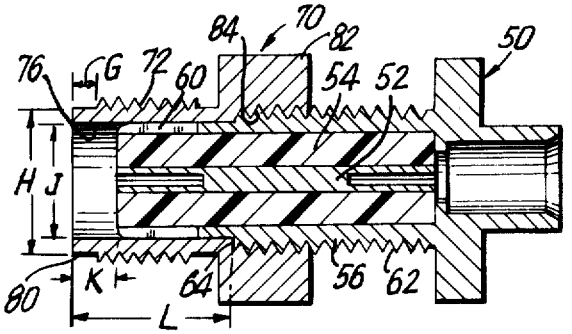
FIG. 4 is a cross sectional view illustrating the adapter of the subject invention as engaged with a female slide on coaxial connector member, such that the configuration of the mating end of the combination substantially corresponds to the configuration of a female coupling connector member.

Referring to FIG. 4, the subject adapter 70 is illustrated mounted on a female slide on connector member 50, such that the mating end of the combination approximates the configuration of a female coupling connector member 12. More specifically, the outer threaded portion 72 of the adapter has a diameter of 0.250 inches and is spaced from the mating end a distance G corresponding to 0.031 inches. The outer diameter H of the mating end 80 is equal to 0.210 inches and substantially corresponds to the outer diameter B of the coupling connector member 12. The minor diameter portion 76 of the adapter 70, which extends from the mating end 80 to circumferential step 78, has an inner diameter J equal to 0.1825 inches, which conforms the inner diameter C of connector member 12. The diameter of minor diameter portion 76 is arranged such that the mating end of the female slide on connector 50 is received therein with the spring fingers 60 being compressed and in tight fitting electrical contact.

The major diameter portion 74 of the adapter 70 is provided with threads 84 which are adapted to engage with the threads 62 of outer conductor 56 of the female slide on connector member. When the adapter 70 is mounted onto a slide on connector member, it is rotated until the distal end 64 of threads 62 abuts circumferential step 78. By this arrangement, the tubular insulator 54 is recessed from the mating end of connector member 50 a distance K equaling 0.076 inches. More specifically, the distance L, between the mating end 80 of the adapter and the circumferential step 78, is 0.240 inches, while the distance between the mating end of member 50 and the distal end 64 of threads 62 is 0.164 inches. Thus, when the adapter 70 is fully tightened onto the slide on connector member, a recess K, substantially corresponding to the recess D of the female coupling connector member 12 is achieved.

Figure 5:
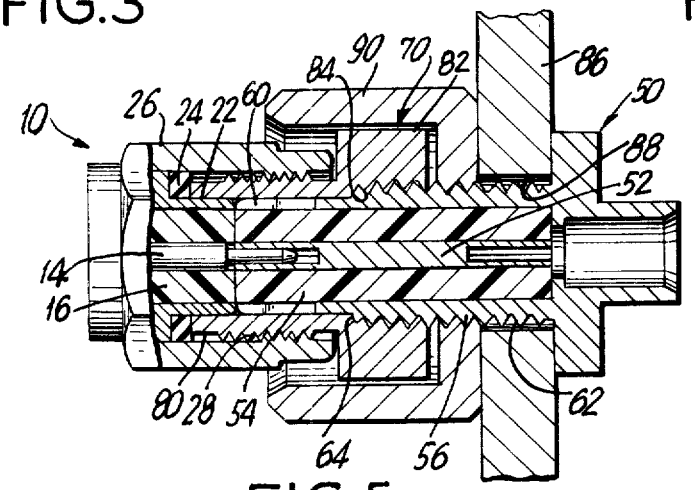
FIG. 5 is a cross sectional view of an interconnected assembly illustrating the adapter of the subject invention providing an interface between a female slide on connector member and a male coupling connector member.

The mounting of adapter 70 on a female slide on connector member 50 facilitates the direct mating between the latter combination and a male coupling connector member 10. More particularly, and as illustrated in FIG. 5, a male coupling connector member 10 is shown with coupling nut 26 mounted thereon. A female slide on connector member 50 is illustrated mounted to a panel 86 through threaded aperture 88 found therein. Preferably, a sleeve 90 is mounted on threads 62 of outer conductor 56 such that it surrounds and protects the mating connection between the connector members. The adapter 70 is mounted on the slide on connector member 50 in a manner similar to that shown in FIG. 4 and described above.

To mate the opposed connector members, slide on connector member 50, which might for example be mounted on movable test equipment, is positioned such that the mating end 80 of the adapter is aligned with and received within coupling nut 26, whereby central conductors 14 and 30 of the connector members are mated. In addition, electrical contact is established between the inner surface of minor diameter portion 76 of the adapter and area 22 of outer conductor 18 of connector member 10. Coupling nut 26 is tightened such that the connector members are drawn together to achieve a high frequency electrical connection. As illustrated in FIG. 5, the mating end 80 of the adapter is in abutting relationship with the sealing O-ring 24 of the male connector member, while the distal ends 92 of the spring fingers 60 are in abutting relationship with the distal end of outer conductor 18. By this arrangement, a quick and simple interconnection is made between a male coupling type coaxial connector member 10 and a female slide on connector member 50 wherein only one interface is necessary thereby maintaining the high performance characteristics of the connection.

In summary, there is provided a new and improved adapter for use with a female slide on coaxial connector member. More particularly, an adapter is provided which may be mounted on the mating end of a slide on connector member for altering the configuration of the latter to approximate the configuration of a female coupling type connector member. The adapter of the subject invention is generally cylindrical in configuration with the outer surface thereof being threaded and with the inner surface having major and minor diameter portions separated by a circumferential step. The major diameter portion is threaded and is adapted to engage with a threaded portion of the female slide on connector member. The minor diameter portion of the adapter, which is disposed adjacent the mating end thereof, has a diameter which is adapted to receive the mating end of the slide on connector member. In use, the adapter facilitates the quick and simple interconnection between a female slide on connector member and a male coupling connector member while not introducing any additional interfaces therebetween that would tend to degrade the high frequency characteristics of the electrical connection.

Although the present invention has been described in the above specification with reference to a specific embodiment, such reference has been made for purely illustrative purposes and various modifications in the details included therein may be made without departing from the scope or spirit of the subject invention as defined by the appended claims.

What is claimed is:

1. A coaxial connector comprising:

a connector member having a mating end and including a central conductor surrounded by a tubular insulator and a generally cylindrical outer conductor, said outer conductor having a threaded portion spaced from said mating end, said mating end including a plurality of longitudinally extending slits defining a plurality of cantilevered spring fingers, with the diameter of said mating end of said outer conductor being less than the diameter of said threaded portion; and an adapter member of elongated, cylindrical configuration having a mating end, with the outer surface of said adapter being threaded, and with the inner surface thereof having major and minor diameter portions separated by a circumferential step, with the minor diameter portion being disposed adjacent the mating end thereof and having an inner diameter substantially corresponding to the outer diameter of said mating end of said conductor member, and with the major diameter portion, disposed at the opposed end of said adapter member, being threaded and adapted to engage with said threaded portion of said connector member, and wherein the mating end of said connector member is receivable within said adapter member, with the threaded portion of said connector member being threadably engaged with the threaded major diameter portion of said adapter member, such that the distal end of said threaded portion abuts said circumferential step of said adapter member whereby the configuration of the mating end of said connector member is altered.

2. A coaxial connector as recited in claim 1 wherein said circumferential step of said adapter member is disposed substantially perpendicular to the longitudinal axis of said adapter.

3. A coaxial connector as recited in claim 1 wherein the outer surface of said adapter member adjacent said opposed end is provided with a hexagonal configuration to facilitate the mounting of said adapter member on said connector member.

4. A coaxial connector as recited in claim 1 wherein the outer diameter of the threaded portion of said adapter member is equal to 0.250 inches.

5. A coaxial connector as recited in claim 1 wherein the diameter of said minor diameter portion of said adapter member is such that said cantilevered spring fingers of said connector member are compressed.

6. A coaxial connector as recited in claim 1 wherein said tubular insulator of said connector member is recessed from said mating end of said adapter member a distance of 0.076 inches.

* * * * *